United States Patent [19]

Beatman

[11] Patent Number: 4,817,549

[45] Date of Patent: Apr. 4, 1989

[54] COMBINED WHISKER POLE AND BOAT HOOK

[76] Inventor: John E. Beatman, 29 Valley Rd., Clinton, Conn. 06413

[21] Appl. No.: 114,840

[22] Filed: Oct. 30, 1987

[51] Int. Cl.[4] ..... B63H 9/4

[52] U.S. Cl. ..... 114/102; 114/221 R

[58] Field of Search ..... 114/39.1, 89, 90, 97–99, 114/102, 103, 115, 221 R, 230

[56] References Cited

U.S. PATENT DOCUMENTS

| | | | |
|---|---|---|---|
| 179,127 | 6/1876 | Norcross | 114/221 R |
| 806,019 | 11/1905 | Sullivan et al. | 114/221 R |
| 1,852,629 | 4/1932 | Sturges | 114/230 |
| 3,464,379 | 9/1969 | Lawson | 114/102 |
| 3,918,385 | 11/1975 | Wallace | 114/221 R |
| 4,037,554 | 7/1977 | Foscolo | 114/221 R |
| 4,292,910 | 10/1981 | Hoyt | 114/102 |
| 4,539,927 | 9/1985 | Foresman | 114/89 |
| 4,708,083 | 11/1987 | Billings | 114/211 R |

OTHER PUBLICATIONS

Forespar, 1984 Catalog, Tustin, CA, Fores Mfg. Corp.

*Primary Examiner*—Sherman D. Basinger
*Assistant Examiner*—Stephen P. Avila
*Attorney, Agent, or Firm*—Bachman & La Pointe

[57] ABSTRACT

A sailboat having a foresail is disclosed including a combination whisker pole and boat hook where the whisker pole portion includes a cleat for securing an idle foresail sheet to retain the pole in contact with the foresail clew releasably.

15 Claims, 1 Drawing Sheet

COMBINED WHISKER POLE AND BOAT HOOK

BACKGROUND OF THE INVENTION

The present invention relates to sailboats and, in particular, to sailboat accessories.

More particularly, the invention relates to boat hooks and to whisker poles.

Most water craft, motor boats or sailboats carry a boat hook for "fending off", "picking up" moorings, or hooking into other floating objects. Such a hook is usually in the form of a light spar or pole of a length that is convenient to handle manually.

In addition, sailboats rigged to fly a jib usually carry a whisker pole which also takes the form of a light, extensible spar or pole which is also convenient to handle manually. As is well known, a whisker pole is used in sailboats to make a connection between the clew cringle of a foresail and the mast to enable the foresail to work efficiently when sailing before the wind, i.e., from a beam reach to fully before the wind, especially when the wind is light and variable, to keep the foresail from collapsing.

Representative examples of prior art boat hooks are shown and described in U.S. Pat. Nos. 179,127 issued June 27, 1876; 1,852,629 issued Apr. 1932; 3,918,385 issued Nov. 11, 1975 and 4,037,554 issued July 26, 1977.

These patents show, in one fashion or another, manually operable light weight spars fitted with bumpers, hooks, catches and loops for fending off and for snatching mooring buoys.

While these units are operable and have utility their usefulness is limited to the functions described. When not in use boat hooks must be stowed securely, usually on deck, so as to be available on short notice.

In addition, storage space on small boats particularly small sailboats is at a premium.

The need for a small sailboat with a foresail to carry both a boat hook and a separate whisker pole places an undue burden upon the availability of deck or hull storage space.

SUMMARY OF THE INVENTION

Consequently, it is a primary feature of the present invention to provide a combined boat hook and whisker pole as a singe light weight manually operable pole or spar defining unitary structure.

It is a further feature of the invention to provide a pin or spike on the forward end of the spar operable to engage the clew cringle or sheet knot of a foresail.

It is a still further feature of the invention to provide a bumper means on the forward end of the spar, offset from and projecting beyond said spike, for fending off.

A still further feature of the invention is the provision of adequate space between the bumper and the spike to accommodate the clew cringle and the margin or hem of sail fabric to which the cringle is secured.

A still further feature of the invention is the arrangement of the spike and the bumper to approximate an acute angle or a Y-shape to facilitate straddling a narrow object when the combined unit is used in fending off.

A still further feature of the invention is the provision of a laterally projecting hook, with or without a bumper, at the outward end of said spar offset laterally and inboard of said spike and said bumper means.

It is a still further feature of the invention to provide a combined boat hook and whisker pole which is extensible in telescoping fashion.

A further feature of the provision of an open hook, snap hook or spring clip at the inboard end of the spar to facilitate connection with a pad eye or the like on the sailboat mast.

A still further feature of the invention is the provision of a cleat means on the spar for securing an idle foresail sheet operable to retain the clew cringle or sheet knot, as the case may be, securely on the spike when the spar is operating as a whisker pole.

A sailboat rig embracing certain features of the present invention may comprise, in combination, a foresail and a mast, said foresail having a clew with a clew cringle, port and starboard sheets secured to said cringle, a single spar means operable, selectively, as a boat hook or as a whisker pole, said spar means having a first or inboard end terminating in a fastener means for engaging the mast and an opposite or outboard end terminating in a bumper means, said outboard end including also a pin or spike means operable to engage said clew, and a cleat on said spar means for securing one of said sheets to retain said clew and said spike means in engagement when said foresail is set to draw.

Other features an advantages of the present invention will become more apparent from an examination of the succeeding specification when read in conjunction with the appended drawings; in which

DESCRIPTION OF THE PREFERRED EMBODIMENTS

Figures 1, 2, 3:
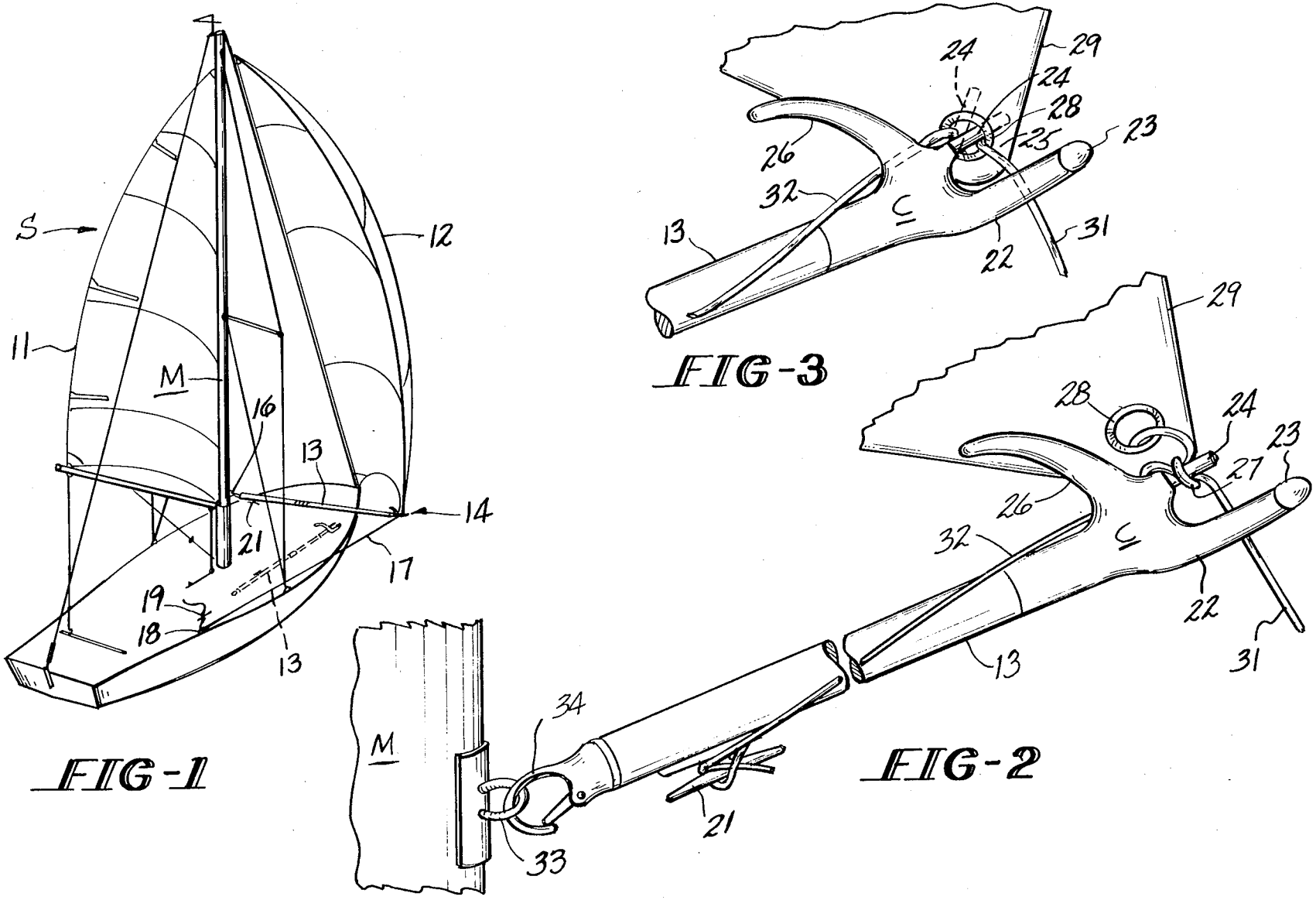
FIG. 1 is a perspective view of a sailboat showing the foresail (jib) set with the combination whisker pole and boat hook of the present invention.
FIG. 2 shows the unit in the whisker pole mode secured at one end to the mast and at the opposite end to a sheet knot; and, FIG. 3 shows an alternative connection of the spike to a clew cringle.

In FIG. 1 a sailboat S is shown underway "wing and wing" before the wind in which a main sail 11 extends to port and a foresail or jib 12 extends to starboard.

A combined whisker pole and boat hook defining a spar 13 is shown connected to the clew of the jib at 14 and the opposite end is shown secured to the mast M as at 16.

Working sheet 17 passing through a fairlead 18 is secured to a deck cleat 19 or hand held in customary fashion.

The idle jib sheet is secured to a cleat 21 on the spar 13 to retain the clew fixed releasably to the spar in a manner which will be more apparent as this specification proceeds.

Note that the spar 13 can be stowed conveniently on the mast, below deck, or on the deck as shown in dashed lines in FIG. 1.

In addition the spar is extensible to a range of different fixed lengths by suitable telescoping mechanisms which are well known in the art.

In this manner the spar 13 when in the whisker pole mode is adjustable to accommodate a reasonable range of foresail foot dimensions and to minimize space needed for storage.

Referring to FIGS. 2 and 3 the spar 13 is formed with a bumper 22 having a resilient nose 23 which projects generally longitudinally of the main body of the spar 13 and is spaced laterally or offset from a projecting clew pin or spike 24. Note that the bumper 22 projects beyond the clew spike 24 for obvious reasons. It may be advisable to "angle" the spike 24 relative to the bumper 22 as shown in dashed lines in FIG. 3 to provide clearance for the cringle 28 and the sail hem 25 and to facilitate straddling narrow objects when the spar is used in the boat hook mode.

The spar also includes a typical hook 26 which together with the bumper 21 represent classic boat hook instrumentalities.

On FIG. 2 the clew spike 24 is shown engaging the sheet knot 27 at the clew cringle 28 of foresail 29 with starboard or working sheet 31 leading to a control means such as a deck cleat (not shown) and with the port or idle sheet 32 leading to and secured at spar cleat 21.

As stated previously, the idle sheet 32 serves to hold the clew securely but in releasable fashion on the spike 24.

The inboard end of the spar 13 is secured to a mast pad eye 33 by a snap hook or spring clip 34 or by an Open C-shaped hook, as desired.

In FIG. 3 the clew spike 24 is shown engaging the clew cringle 28 directly.

For economy of manufacture and as design considerations dictate, it is desirable to fabricate the bumper 22, the spike 24 and hook 26 as a single piece part such as, for example, a bronze casting C. Such a piece part is then rigidly connected to spar 13 by suitable fastening means.

It is to be understood that, although the combined whisker-pole and boat hook has been shown set on the starboard side of the sailboat, it is entirely within the spirit and scope of the invention to set the pole to port or in any other seaman-like manner.

In general, the whisker pole is most effective in downwind sailing in light airs or in variable winds when there is a tendency for a foresail to collapse.

It is assumed that the utility and manner of using the spar 13 as a boat hook is well known to individuals skilled in the boating art.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A nautical spar means comprising:

a boat hook, and a whisker pole combined, said spar means defining an elongated, lightweight, single pole terminating at one end in a fastener means and terminating at the opposite end in a resilient bumper means for fending off, said opposite end being formed further with a hook means for grappling and a fixed pin means, said pin means being operable to engage releasably a clew of a sail means, said pin means, said hook means and said bumper means being arranged so as to be operable independently.

2. The combination of claim 1 in which the bumper means is spaced laterally from and projects longitudinally beyond said pin means.

3. The combination of claim 2 in which the longitudinal axis of the bumper means and the longitudinal axis of the spike means define an acute angle or a Y-shape to accommodate a clew cringle and a sail hem when in the whisker pole mode and to facilitate straddling a narrow object when in the boat hook mode.

4. The combination of claim 1 in which the spar means is fitted with a cleat means for securing a line such as a sail sheet.

5. The combination of claim 1 in which the hook means, the bumper means and the pin means are offset laterally and longitudinally relative to one another so that each means is operable without interference.

6. The combination of claim 5 in which the hook means, the bumper means and the pin means define a one-piece unitary structure fitted securely to said spar means.

7. The combination of claim 1 in which the fastener means defines a C-shaped hook.

8. The combination of claim 1 in which the fastener means is a spring clip or snap hook.

9. The combination of claim 1 in which the spar means is extensible to accommodate sail means of different foot dimensions.

10. A method of securing a clew of a foresail to a whisker pole comprising the steps of:

providing a foresail having a clew and a clew cringel;

providing a mast;

providing port and starboard sheets connected to said clew cringle;

placing the foresail in a working attitude under the control of a working sheet while the other sheet is idle;

connecting the outboard end of the whisker pole to the clew cringle and connecting the inboard end thereof to the mast; and, retaining the clew securely connected to the whisker pole by tensioning the idle sheet.

11. In combination, a sailboat having a foresail and a mast, said foresail having a clew, port and starboard sheets secured to said clew for controlling the foresail, a lightweight spar means defining a combined boat hook and whisker pole, said spar means having an inboard end terminating in a fastening means, and an outboard end terminating in a resilient bumper means, said outboard end including a fixed spike or pin means operable to engage said clew and hook means for grappling.

12. The combination of claim 11 in which said spar means is fitted with a cleat means for making one of said sheets fast.

13. The combination of claim 12 above in which the mast is fitted with a pad eye means for engaging said fastening means whereby said spar means when used in the whisker pole mode is operable to hold the foresail clew securely and releasably.

14. The combination of claim 12 in which the sheet that is normally made fast to said cleat means is an idle sheet.

15. A method of securing a clew of a foresail to a whisker pole comprising the steps of providing a foresail having a clew and a clew cringle;

providing a cleat on the whisker pole;

providing a mast;

providing port and starboard sheets connected to said clew cringle;

placing the foresail in a working attitude under the control of a working sheet while the other sheet is idle;

connecting the outboard end of the whisker pole to the clew cringle and connecting the inboard end thereof to the mast; and, retaining the clew securely connected to the whisker pole by tensioning the idle sheet and making it fast releasably to the cleat on the whisker pole.

* * * * *